US005385496A

United States Patent [19]

Seligman

[11] Patent Number: 5,385,496

[45] Date of Patent: Jan. 31, 1995

[54] BUOYANCY COMPENSATOR WITH LATERAL EXPANSION AND METHOD THEREFOR

[75] Inventor: Scott P. Seligman, Carlsbad, Calif.

[73] Assignee: Sea Quest, Inc., Carlsbad, Calif.

[21] Appl. No.: 44,225

[22] Filed: Apr. 7, 1993

[51] Int. Cl.[6] ..... B63C 9/08

[52] U.S. Cl. ..... 441/115; 405/186; 441/88

[58] Field of Search ..... 441/88, 92–118; 405/186; 156/292, 275.1, 275.5

[56] References Cited

U.S. PATENT DOCUMENTS

| | | | |
|---|---|---|---|
| 2,999,255 | 9/1961 | Lanciano, Jr. et al. | 441/91 |
| 4,000,534 | 1/1977 | Cerniway | 9/342 |
| 4,137,585 | 2/1979 | Wright | 9/314 |
| 4,523,914 | 6/1985 | Faulconer | 441/108 |
| 4,690,314 | 9/1987 | Faulconer | 224/211 |
| 4,694,772 | 9/1987 | Faulconer | 114/315 |
| 4,778,307 | 10/1988 | Faulconer | 405/186 |
| 4,823,417 | 4/1989 | Fukuichi | 5/455 |
| 4,906,502 | 3/1990 | Rudy | 36/29 |
| 4,913,589 | 4/1990 | Fauconer | 405/186 |
| 4,960,483 | 10/1990 | Switlik | 441/118 |

*Primary Examiner*—Edwin L. Swinehart

*Attorney, Agent, or Firm*—George F. Bethel; Patience K. Bethel

[57] ABSTRACT

A buoyancy compensator for a diver having an inflatable bladder characterized by minimal lateral deformation when inflated is formed of a two piece gusset of double-sided heat sealable material disposed between a forward and a rearward single-sided heat sealable member. A method for making the inflatable bladder by welding in three roughly parallel planes is also provided.

17 Claims, 4 Drawing Sheets

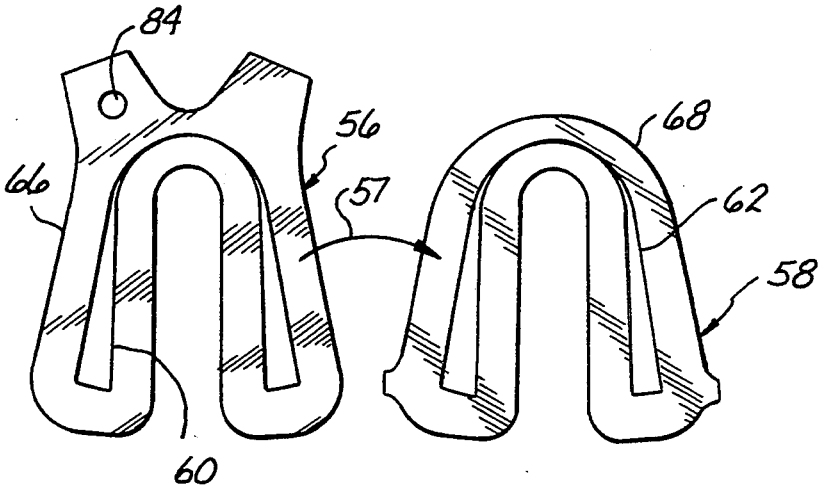
Fig. 4
Fig. 5
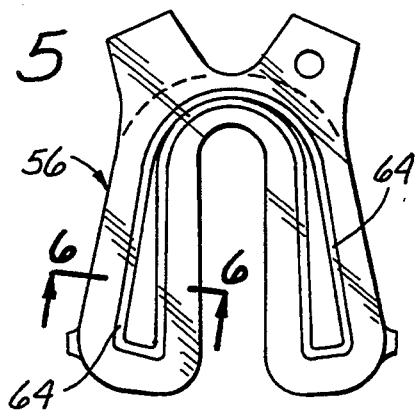
Fig. 6
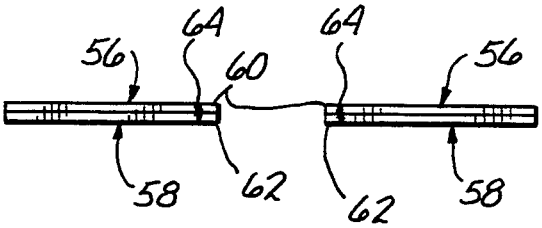
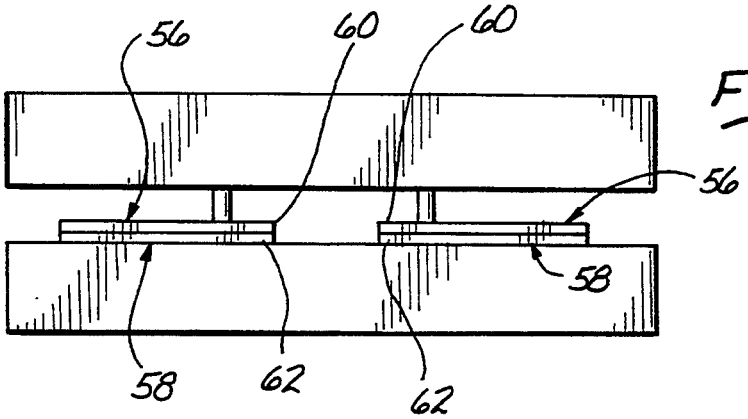
Fig. 7

Fig. 8
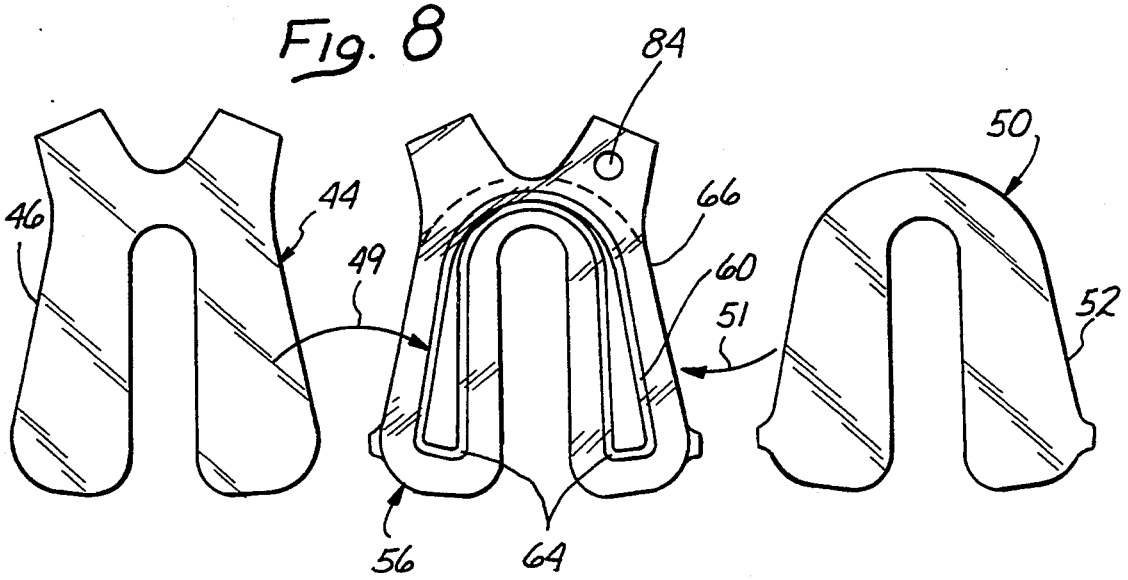
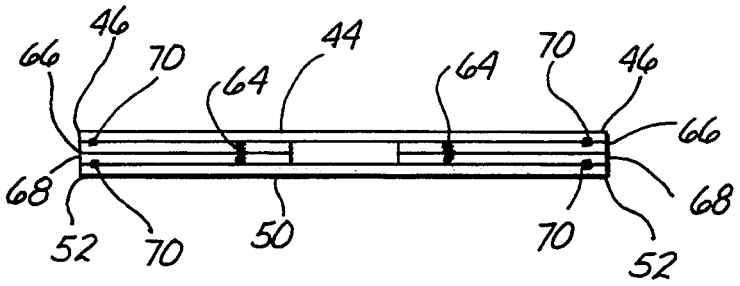
Fig. 10
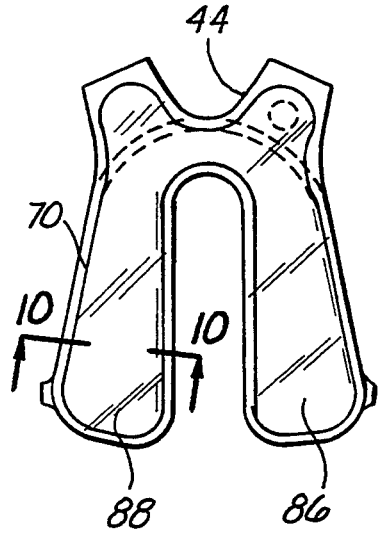
Fig. 9

BUOYANCY COMPENSATOR WITH LATERAL EXPANSION AND METHOD THEREFOR

FIELD OF THE INVENTION

This invention relates to the field of buoyancy compensators. It particularly relates to a buoyancy compensator and method for producing the air retaining bladder or chamber in a manner whereby a conventional heat sealing press can be utilized to produce a bladder with minimal lateral distortion of the bladder during inflation.

DESCRIPTION OF THE PRIOR ART

Buoyancy compensators of the prior art in recent years have been primarily those of a vest type having an inflatable chamber or bladder. These vest type buoyancy compensators are inflated or deflated to provide for buoyancy trim or compensation to a diver.

Buoyancy compensators are inflated by oral as well as power or compressed gas inflation means. During inflation, the diver is provided with increased buoyancy at greater depths to overcome the fact that a diver's buoyancy decreases as he dives deeper. This is due to the fact that with greater pressure, a loss takes place with regard to the lifting characteristics of the diver's buoyancy, primarily due to compression of his exposure suit and associated diving equipment.

Conversely, as the diver ascends or approaches the surface his buoyancy tends to increase as the compression of his exposure suit and other equipment recovers. As inherent buoyancy is regained, air must be released from the buoyancy compensator to return the system to neutral buoyancy.

Thus, by increasing or decreasing the buoyancy provided by the buoyancy compensator, a diver can adjust his buoyancy to a neutral state. This is provided by either adding air to the buoyancy compensator or releasing it.

Buoyancy compensators are often utilized to hold a diver's backpack on the back and utilize shoulder straps and/or a belt strap to secure the buoyancy compensator to a diver. During the process of inflation and deflation, the buoyancy compensator's inflatable bladder or inner chamber changes dimensions substantially compared with its uninflated state.

In the prior art buoyancy compensators, it has been customary to provide the inflation bladder or chamber by means of sealing together two pieces of material as shown in FIG. 2 in cross section. Sealing is commonly done by means of heat welding on a press, but it can also be done by adhesively bonding the material together in short sections to form the seam by hand.

When the bladder or inner chamber of such a buoyancy compensator is inflated, the dimensions of the interior are substantially deformed so that upon inflation the original, relatively flat configuration becomes more spherical in shape. This change in dimension results in discomfort to the diver since the bladder must expand against the diver's body and there is no opportunity for the interior dimensions to be adjusted.

In an effort to overcome this disadvantage, manufacturers have inserted a gusset between the two major pieces of material forming the inflatable bladder or chamber portion of the buoyancy compensator.

Due to the irregular and curved shape of the buoyancy compensator, the insertion of the gusset has resulted in significantly increased manufacturing costs.

This is due to the fact that in order to avoid producing many folds and wrinkles when the convoluted, irregular shape of the gusset is bonded to the major pieces it is necessary to hand or manually bond the gusset to the major portions of the buoyancy compensator in short sections.

The gusset added by the prior art methods included a relatively narrow piece of material which was folded and manually bonded to the front and back major portions of the buoyancy compensator to provide a bladder as shown in FIGS. 1*a* and 1*b* in cross section.

This innovation was successful in part in that the resulting configuration had a more oval and slightly more flattened configuration than that of the original buoyancy compensator bladder or chamber configuration. Also, when fully inflated, the gusseted shape experienced less lateral deformation than the shape of FIG. 2. However, the gusseted shape of FIGS. 1*a* and 1*b* could not be fabricated through automated methods involving a conventional heat sealing press without creating multiple folds and wrinkles. Fabrication required hand bonding to avoid undesired folds and wrinkles.

The novelty of this invention involves the use of a two piece gusset with specially prepared surfaces such that either side of the gusset material can be welded. This allows the gusset material to be welded to itself in a conventional heat sealing press creating a two piece gusset. The welded gusset can then be welded to front and rear major sheets in a conventional heat sealing press to create a vessel or bladder comprising a buoyancy compensator.

SUMMARY OF THE INVENTION

A new buoyancy compensator having a novel inflatable bladder or chamber configuration has now been discovered according to the instant invention which can be manufactured by automated methods to reduce production costs. The buoyancy compensator produced thereby minimizes lateral expansion of the bladder or chamber interior during inflation.

The new buoyancy compensator of the invention can be produced by welding or bonding for example, by means of radio frequency energy or heat set in a conventional heat sealing press or die in two steps to reduce costs as well as to provide a superior product.

The novel buoyancy compensator of the invention includes an inflatable bladder or chamber which is comprised of a pair of spaced apart flexible sheet members cut into the desired configuration to form forward or first major members and rearward or second major members. Interposed between the pair of forward or first and rearward or second flexible sheet members is a gusset which is formed of two separate pieces of flexible sheet members. The gusset is formed by sealing along one edge portion and then sealing one free edge portion to a respective forward and rearward member.

The first step of the novel inventive method includes cutting the inner and outer flexible sheets forming the forward and rearward major portions of the inflatable chamber of the buoyancy compensator. The second step includes cutting the two members forming the gusset.

Assembly includes two welding or bonding steps. The first step involves welding the gusset pieces together along an edge portion preferably in a conventional heat sealing press or die. This step is followed by welding or bonding one free edge of the gusset to the forward or first sheet member and one free edge of the gusset to the rearward or second flexible sheet member in a single operation, preferably in a conventional heat sealing press or die.

Thus, the novel buoyancy compensator of the invention can be manufactured in two simple welding or bonding steps to reduce manufacturing costs. By using double-sided heat sealable material to form the gusset, the gusset pieces can be placed in a die and sealed to itself along an edge portion. The free edges of the gusset can then be placed in a die and sealed or bonded to the major pieces which are comprised of single-sided heat sealable material. By this novel method, the folds and wrinkles which normally develop in the gusset wall interface of prior art designs and which prevent sealing on a conventional press or die are significantly minimized.

This is accomplished by providing for a two-piece gusset of double-sided heat sealable material and the two major pieces of single-sided heat sealable material to enable making all the welds or other securement in three roughly parallel planes. This is not practically achievable with a one piece gusset.

Moreover, when inflated, the inflatable bladder or chamber of the novel buoyancy compensator of the invention is minimally distorted laterally as compared to some bladders or chambers of prior art buoyancy compensators. This feature improves the comfort to a diver during use.

BRIEF DESCRIPTION OF THE DRAWINGS

The invention will be more clearly understood by reference to the attached drawings in which:

FIG. 4 shows a plan view of the two separate material pieces used for manufacturing the gusset.

FIG. 5 shows the gusset with matching edge portions secured together.

FIG. 6 shows a cross section of the gusset of FIG. 5 taken along lines 6—6 of FIG. 5.

FIG. 7 shows an elevation of a sealing die for securing together the two portions of the gusset of FIGS. 5 and 6.

FIG. 8 shows the construction of the inflatable chamber or bladder of the buoyancy compensator of the invention with the forward and rearward flexible sheet members which are secured to the gusset.

FIG. 9 shows the assembled inflatable chamber or bladder of the buoyancy compensator of the invention.

FIG. 10 shows a cross section of the inflatable chamber of FIG. 9 taken along the lines 10—10 of FIG. 9.

DETAILED DESCRIPTION OF THE DRAWINGS

It is a particular feature of the invention that the inflatable chamber or bladder of the buoyancy compensator of the invention exhibits minimal lateral distortion upon inflation.

Figure 2:
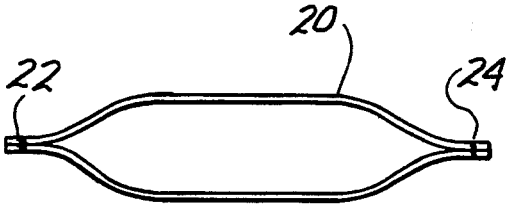
Fig. 2 PRIOR ART
FIG. 2 shows a cross section of a prior art buoyancy compensator bladder.

In the prior art showing of FIG. 2, the inflatable chamber or bladder 20 is welded or secured along its edge portions 22 and 24 as shown. This can be accomplished in a single welding step.

Upon inflation, the inflatable bladder 20 assumes a more spherical configuration causing it to press inwardly against the diver's body and causing discomfort.

Figure 1A:
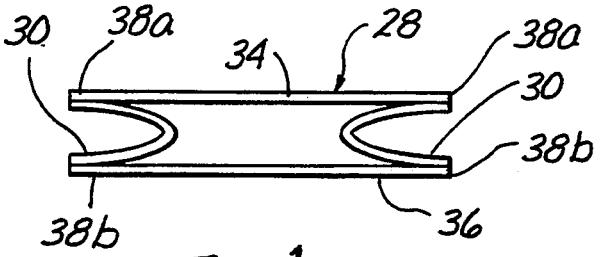
Fig. 1a PRIOR ART
FIG. 1*a* shows a cross section of a partially inflated bladder of a buoyancy compensator of the prior art; and, FIG. 1*b* shows a cross section of the prior art bladder of FIG. 1*a* in its inflated condition.
Figure 1B:
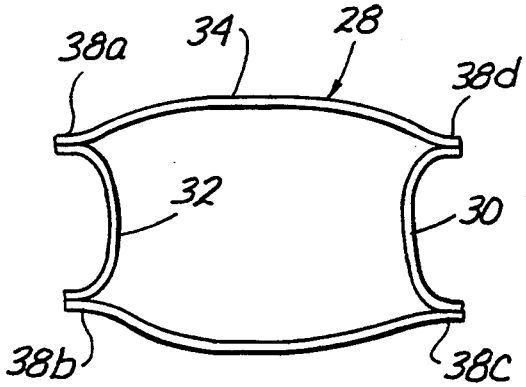
Fig. 1b PRIOR ART

An improved prior art inflatable bladder or chamber for a buoyancy compensator is shown in FIG. 1*a* as indicated at 28. Here, gusset 30 formed of a single, hoop shaped, folded piece of material is inserted between major pieces 34 and 36. The gusset 30 is secured to major pieces 34 and 36 along an edge region as shown at 38*a* and 38*b*. Since the gusset is formed of a single strip, it does not readily form into a hoop to allow sealing of the edges to the front and rear major pieces. Consequently, hand sealing of short sections is required.

It should be noted that the prior art bladder of FIG. 1*a* has outer major pieces 34 and 36 which can be formed of a single-sided heat sealable fabric with the heat sealable surface facing the interior of the chamber 28. Similarly, the gusset 30 is also formed such that the sealable surface is facing the interior of the chamber 28. Welding of the respective major pieces 34 and 36 to the gusset 30 is accomplished by adhesive bonding by hand to allow the structure to be manipulated as necessary to obtain a piece wise bond.

By contrast, the inflatable bladder or chamber of the invention for use in a buoyancy compensator as shown in FIGS. 3–13 can be manufactured by an automated method using a conventional heat sealing press or die. As shown particularly in FIGS. 12 and 13, the inflatable bladder or chamber 42 of the invention comprises a first or forward major flexible sheet member 44 preferably formed of a single-sided heat sealable fabric.

The heat sealable side faces the interior of the chamber 42. The first flexible member 44 includes edge region 46. A second or rearward flexible major sheet portion 50 is also preferably formed of a single-sided heat sealable fabric wherein the heat sealable portion faces the interior of the inflatable chamber 42. Flexible sheet member 50 has edge region 52.

Between the main flexible sheet members 44 and 50 is disposed a gusset formed of two separate pieces. These include first and second flexible gusset sheet members 56 and 58, each forming an inverted outer substantially U shape and an inverted inner substantially U shape joined at the feet. Flexible sheet members 56 and 58 which make up the gusset are preferably formed of double-sided heat sealable fabric.

Figure 12:
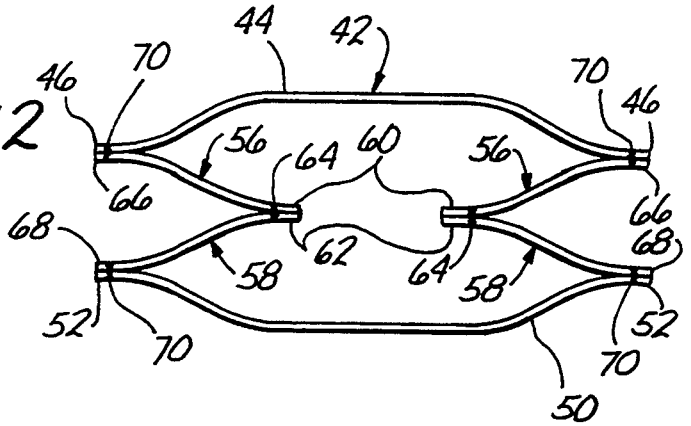
FIG. 12 shows a cross section of the buoyancy compensator inflatable bladder of the invention in its partially expanded configuration.
Figure 13:
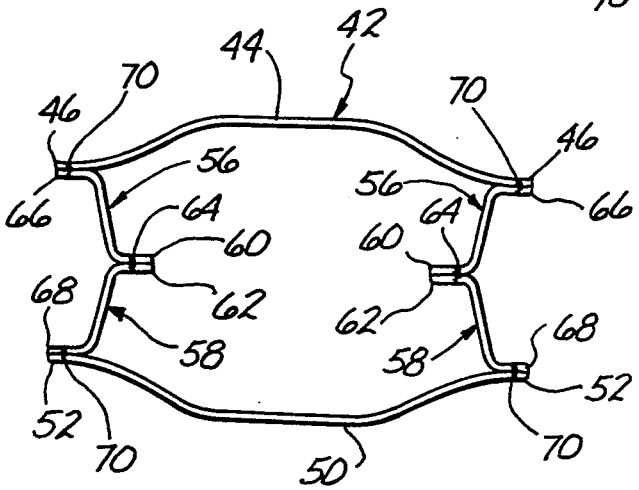
FIG. 13 shows a cross section of the buoyancy compensator inflatable bladder of the invention in its expanded condition.

The two first and second flexible gusset pieces 56 and 58 making up the gusset are sealed or welded together along matching edges 60 and 62 as shown in FIGS. 4 and 12. As shown in FIG. 4, first gusset member 56 is placed on top of second gusset member 58 as indicated by the arrow 57. This is done in such a way as to align or match edges 60 and 62. As can be seen in FIGS. 5, 6 and 12, the edge regions 60 and 62 are welded or sealed at 64.

Referring to FIGS. 4 and 12, it can be seen that first gusset piece 56 has a continuous edge region 66 and second flexible gusset piece 58 has a continuous edge region 68. Edge region 46 of first or main flexible member 44 is welded or sealed to gusset member 56 at matching edge region 66. Similarly, main flexible member 50 having edge region 52 is bonded to gusset member 58 at matching edge region 68.

The gusset members 56 and 58 can be seen in detail in the showing of FIG. 4. It can be seen that first and second gusset members 56 and 58 have matching inner edge regions 60 and 62 for joining together. As indicated by the arrow 57, first gusset piece 56 is placed or stacked on top of second gusset piece 58 with the .edge regions 60 and 62 aligned. These inner edge regions 60 and 62 of the gusset members 56 and 58 are then placed in a die and heat sealed or bonded together.

Gusset members 56 and 58 can be joined or bonded together along curved inner edge portions 60 and 62 using a die as shown in FIG. 7. This produces the gusset as shown in FIG. 5 with the interior facing members joined along their edge portions in a weld line or bond 64. A cross section of the gusset with the bond 64 can be seen in FIG. 6.

After the gusset has been formed as shown in FIGS. 4, 5 and 6, the first and second major outer members 44 and 50 can be joined thereto. This can be done in the manner indicated in FIGS. 8, 9, 10, and 11. The exterior edge region 66 of gusset member 56 corresponds to and matches the configuration of edge region 46 of major flexible member 44 and edge region 68 of gusset member 58 corresponds to and matches the configuration of edge region 52 of major flexible member 50.

In particular reference to FIG. 8, first major member 44 is placed or stacked on top of gusset member 56 as indicated by arrow 49 with edge portion 46 of first member 44 matching edge portion 66 of gusset member 56. Similarly, second major member 50 is placed under gusset member 58 with edge portion 52 of second major member 50 matching edge portion 68 of gusset member 58 as indicated by arrow 51.

Figure 11:
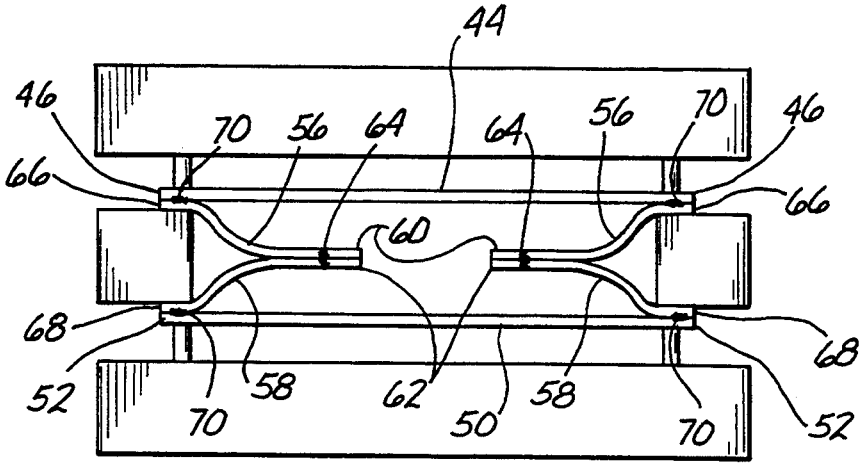
FIG. 11 shows an elevation of a sealing die containing the forward and rearward members of the inflatable chamber being welded to the gusset.

As shown in the die of FIG. 11, the final step for sealing the inflatable bladder or chamber takes place by positioning the gusset members 56 and 58, previously sealed together as above described in a die shown in FIG. 7, within the die shown in FIG. 11. At the same time, major member 44 and major member 50 are positioned within the die as well so that the matching edge regions are aligned as above described.

It can be seen in FIG. 11 in cross section that the previously bonded or sealed gusset members 56 and 58 are sealed to the major flexible members 44 and 50 with the sealing step shown herein. This sealing step completes the joining of the inflatable bladder at die line 70 as shown in FIG. 9 and FIG. 11.

It can be appreciated that this sealing step effectively bonds the flexible members 44, 50, 56, and 58 together in three roughly parallel planes. This enables the inflatable chamber of the buoyancy compensator of the invention to be formed in a two step bonding process using a conventional heat sealing press or die. At the same time the method produces a bladder which is minimally deformed in the lateral dimension upon inflation.

The respective layers 44, 50, 56, and 58 are preferably sealed together by bonding with radio frequency energy. The flexible material is preferably formed of a fabric such as a nylon or other woven material having a plastic sealant or coating on two sides of the material for the gusset members 56 and 58 and on one side of the material for the major pieces 44 and 50. An unwoven material can also be used if desired but is less preferred unless it has significant tear strength and flexibility equivalent to a woven material.

Also, while a single gusset is shown the invention is intended to include two or more gussets, each formed of two pieces and sealed in the same way by sealing or bonding the edge regions in roughly parallel planes.

While a heat sealable coating on the fabric is preferred, the invention is not limited thereto. In place thereof, there can be used a sealant or adhesive in the edge regions with or without heat sealing to provide an air tight bond between the respective members.

If desired the edge regions 46 and 66 as well as edge region 68 and 52 can be bound with an edge binding to provide additional strength and wear resistance.

Figure 3:
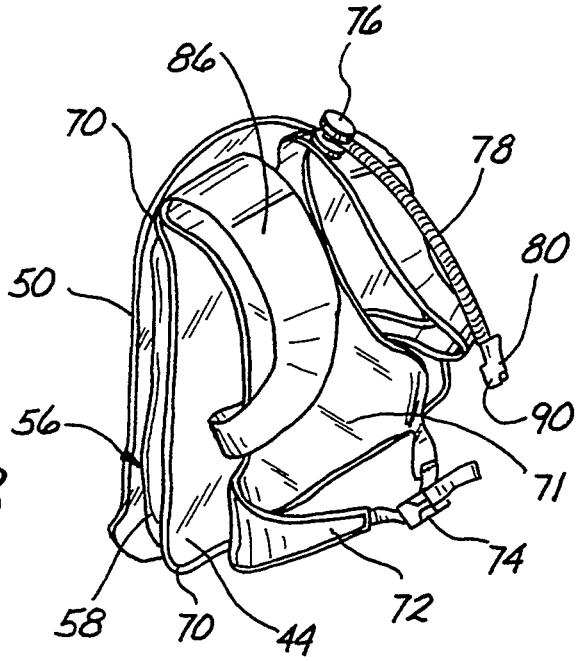
FIG. 3 shows a perspective view of the buoyancy compensator of the invention in its entirety with some of the auxiliary attachments.

The inflatable bladder or chamber 42 of the invention is incorporated within a buoyancy compensator as shown in perspective in FIG. 3. The back of the buoyancy compensator which is not shown has a configuration as shown in FIG. 9 having two downwardly projecting sections 86 and 88 in order to accommodate a tank against the rear portion. The inner portion of the inflatable chamber 42 which includes a first or forward major member 44 is stitched to and forms a part of shoulder strap 86.

The strap 86 crosses behind back portion 71 which forms an inner layer adjacent inflatable bladder 42. These straps 86 cross behind and are disposed between inflatable bladder 42 and back member 71 and are threaded into waist members 72 to be secured by buckles 74 around a diver's waist.

As shown in FIGS. 4 and 5, gusset member 56 is provided with an opening 84 for emplacement of an over pressure release valve member 76. Attached to the release valve member 76 is an inflator tube 50 which terminates in an end connector 80. End connector 80 has a mouthpiece 90 and a means, not shown, in the form of a depress valve button which is in communication with a valve for inflation by means of an interconnecting tube with a high pressure line through a tank or cylinder not shown. Such an arrangement as above described is known to those skilled in the art. The invention is intended to include a buoyancy compensator having the novel inflatable chamber or bladder 42 as above described.

The novel inflatable bladder is not limited to use in a buoyancy compensator. It is also intended that such an inflatable bladder or chamber can be used as a flotation device. For example, the inflatable bladder can be part of a life vest wherein the inflatable chamber 42 is configured to be worn around a user's neck in the manner of a life preserver or in various combinations as will be apparent to those skilled in the art.

The particular feature of the invention as described above includes the two step bonding process by which the inflatable chamber 42 can be manufactured at a reduced cost. By employing double-sided sealable material to construct a two-piece gusset and a single-sided sealable material for the major pieces, the fabric layers can be stacked in roughly parallel planes. This permits welding of the fabric layers with a minimum of folds and wrinkles along the sealed edges. In addition, the resulting chamber exhibits minimal lateral distortion during inflation to increase comfort for a user.

Various modifications of the invention are contemplated and can be resorted to by those skilled in the art without departing from the spirit and scope of the invention as defined by the following claims.

I claim:

1. A method for making an inflatable chamber for a diver's buoyancy compensator from flexible fabric wherein said inflatable chamber is characterized by limited loss in the lateral dimension upon inflation comprising:

providing two flexible material gusset sheet members, each sheet member having an interior and an exterior peripheral edge portion wherein said interior peripheral edge portions have matching interior configurations defining a partially open interior;

providing two flexible major sheet members, each major sheet member having a peripheral edge portion, which has a matching configuration with one or the other of said gusset sheet member exterior peripheral edge portions;

providing a die;

placing said two gusset sheet members within said die with said two matching interior peripheral edge portions on top of each other;

sealing said two gusset sheet members within said die whereby each said two matching interior peripheral edge portions are sealed in a single plane to form a gusset;

removing each said gusset from said die;

indexing each of said unsealed exterior peripheral edge portions of said gusset with a matching exterior peripheral edge portion of said flexible major sheet members;

providing a die;

placing said matching exterior peripheral edge portions within said die and sealing said matching edge portions in two substantially parallel planes which are also substantially parallel to said first substantially parallel plane; and, removing said sealed gusset and major sheet members to define an inflatable chamber having three substantially parallel sealed edge regions.

2. A method according to claim 1 wherein said gusset and said major flexible members are formed of a fabric having a coating of a heat sealable material disposed on one or both sides.

3. A method according to claim 2 wherein said gusset members are formed of a double-sided heat sealable material and wherein said major members are formed of a single-sided heat sealable material; and, wherein said two flexible material gusset sheet members have nonmatching exterior peripheral edge portions.

4. A method according to claim 1 wherein said heat sealing within said die is done by radio frequency heating.

5. A buoyancy compensator having an inflatable bladder comprising:

a first strip of flexible material forming an inverted outer substantially U shape and an inverted inner substantially U shape joined at the feet, the resulting shape having a first inner edge region defining an inverted cut out substantially U shape, and a first outer peripheral edge region having an inverted substantially U shape;

a second strip of flexible material defining an inverted outer substantially U shape and an inverted inner substantially U shape joined at the feet, the resulting shape having a second inner edge region defining an inverted cut out substantially U shape matching said first inner edge region, and a second outer peripheral edge region having an inverted substantially U shape;

said first and said second inner edge regions being matched and sealed along said matched edge regions to form a two piece curved gusset;

a third piece of flexible material defining an inverted outer substantially U shape having a third outer peripheral edge region matching said first outer edge region of said first piece of material and sealed along said first and said third outer edge regions; and, a fourth piece of flexible material defining an inverted outer substantially U shape having a fourth outer peripheral edge region matching said second outer edge region of said second piece of material and sealed along said fourth and said second outer edge regions to define two downwardly extending inflatable chambers having a substantially inverted U shape.

6. An inflatable chamber according to claim 5 wherein said third and fourth piece of flexible material include a fabric having a high frequency wave fusible plastic sheet disposed at least along the edge portions thereof; and, wherein said gusset pieces include a fabric having a high frequency fusible plastic sheet disposed at least along the edge portions on each side of said fabric.

7. An inflatable chamber according to claim 6 wherein said third and fourth piece of flexible material are comprised of single-sided heat sealable fabric and wherein said gusset pieces are comprised of double-sided heat sealable fabric.

8. An inflatable chamber according to claim 7 wherein said gusset is initially formed by heat sealing facing first and second inner edge regions and said gusset is joined to said single-sided heat sealable fabric of said third and fourth piece along respective matched facing second and fourth outer edge portions by heat sealing.

9. An inflatable chamber according to claim 8 wherein said fabric is formed of a nylon material having a heat sealable coating on one or both sides.

10. An inflatable chamber according to claim 8 wherein said heat sealed edges to form said gusset are on one side of said double-sided heat sealable fabric and said second heat sealed edge portions are on the opposite side of said double-sided heat sealable fabric.

11. An inflatable chamber according to claim 7 having a substantially inverted "U" shape defining a back portion of a buoyancy compensator.

12. A method for forming an inflatable chamber for a flotation device comprising:

providing a first strip of flexible material defining an inverted outer substantially U shape and an inverted inner substantially U shape joined at the feet, the resulting shape having a first inner edge region defining an inverted cut out substantially U shape and a first outer peripheral edge region having an inverted substantially U shape;

providing a second strip of flexible material defining an inverted outer substantially U shape and an inverted inner substantially U shape joined at the feet, the resulting shape having a second inner edge region defining a inverted cut out U shape matching said first inner edge region and a second outer peripheral edge region having an inverted U shape;

indexing said first inner edge region and said second inner edge region;

sealing along said matched edge regions to form a two piece curved gusset;

providing a third piece of flexible material having an inverted outer substantially U shape defining a third outer peripheral edge region matching said first outer edge region of said first piece of material;

indexing said first outer edge region and said third outer edge region;

sealing along said first and said third outer edge regions;

providing a fourth piece of flexible material having an inverted outer substantially U shape defining a fourth outer peripheral edge region matching said second outer edge region of said second piece of material;

indexing said second outer edge region and said fourth outer edge regions; and, sealing along said second and said fourth outer edge regions.

13. A method according to claim 12 wherein said inflatable chamber has a substantially inverted "U" shaped configuration.

14. A method according to claim 13 wherein said first, second, third and fourth flexible materials are formed of a heat sealable fabric.

15. A method according to claim 14 wherein said first and second flexible materials forming said gusset members are formed of a double-sided heat sealable material and wherein said third and fourth flexible materials are formed of a single-sided heat sealable material.

16. A method according to claim 15 wherein said heat sealable material is formed of a fabric having a coating of a heat sealable plastic disposed on one or both sides.

17. A method according to claim 16 wherein said heat sealing within said die is done by radio frequency sealing.

* * * * *